US011495386B2

(12) United States Patent
Nanbara et al.

(10) Patent No.: US 11,495,386 B2
(45) Date of Patent: Nov. 8, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Shintaro Nanbara, Mie (JP); Kazushi Kusawake, Mie (JP); Yusaku Maeda, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 565 days.

(21) Appl. No.: 16/489,097

(22) PCT Filed: Feb. 23, 2018

(86) PCT No.: PCT/JP2018/006785
§ 371 (c)(1),
(2) Date: Aug. 27, 2019

(87) PCT Pub. No.: WO2018/159503
PCT Pub. Date: Sep. 7, 2018

(65) Prior Publication Data

US 2020/0075215 A1 Mar. 5, 2020

(30) Foreign Application Priority Data

Mar. 3, 2017 (JP) ..... JP2017-041148

(51) Int. Cl.
*H01F 27/30* (2006.01)
*H01F 27/24* (2006.01)
(Continued)

(52) U.S. Cl.
CPC ..... *H01F 27/025* (2013.01); *H01F 27/24* (2013.01); *H01F 27/306* (2013.01);
(Continued)

(58) Field of Classification Search
CPC ..... H01F 27/025; H01F 27/24; H01F 27/306; H01F 27/324; H01F 41/0246; H01F 37/00; H01F 27/02; H01F 27/022
See application file for complete search history.

(56) References Cited

U.S. PATENT DOCUMENTS 7,825,762 B2 * 11/2010 Arai ..... H01F 27/022 336/96
2011/0156853 A1 6/2011 Kato et al.
2012/0154093 A1 6/2012 Yoshikawa et al.
2013/0249666 A1 9/2013 Suzuki et al.
(Continued)

FOREIGN PATENT DOCUMENTS

JP 2006-310539 A 11/2006
JP 2009-231495 A 10/2009
(Continued)

OTHER PUBLICATIONS

International Search Report, Application No. PCT/JP2018/006785, dated May 29, 2018. ISA/Japan Patent Office.

*Primary Examiner* — Tuyen T Nguyen
(74) *Attorney, Agent, or Firm* — Honigman LLP

(57) ABSTRACT

A reactor including: a coil including a pair of winding portions that are arranged side by side; a magnetic core including inner core portions that are provided inside the winding portions, and an outer core portion that is exposed to the outside from the winding portions; and a casing that houses a combined member that includes the coil and the magnetic core combined with each other. The casing includes: a bottom plate on which the combined member is placed; and a side wall that stands on the bottom plate, and the side wall is provided with a cutout for the core, through
(Continued)

which at least a portion of the outer core portion is exposed to the outside of the casing.

9 Claims, 7 Drawing Sheets

(51) Int. Cl.
*H01F 27/02* (2006.01)
*H01F 27/32* (2006.01)
*H01F 41/02* (2006.01)
*H01F 37/00* (2006.01)

(52) U.S. Cl.
CPC ..... *H01F 27/324* (2013.01); *H01F 41/0246* (2013.01); *H01F 37/00* (2013.01)

(56) References Cited

U.S. PATENT DOCUMENTS

| | | | |
|---|---|---|---|
| 2014/0085026 | A1 | 3/2014 | Yamada et al. |
| 2014/0133204 | A1 | 5/2014 | Yoshikawa |
| 2014/0292456 | A1 | 10/2014 | Suzuki et al. |

FOREIGN PATENT DOCUMENTS

| | | | |
|---|---|---|---|
| JP | 2010-118465 | A | 5/2010 |
| JP | 2013-115140 | A | 6/2013 |
| JP | 2013-149869 | A | 8/2013 |
| JP | 2015-012147 | A | 1/2015 |
| JP | 2015-095563 | A | 5/2015 |
| JP | 2015-153929 | A | 8/2015 |
| JP | 2015-170674 | A | 9/2015 |
| JP | 2018-041927 | A | 3/2018 |
| WO | 2011-101976 | A1 | 8/2011 |

* cited by examiner

10:2, 3 3:31, 32 4:2, 5 5:50, 51, 52 6:60, 61

REACTOR

CROSS-REFERENCE TO RELATED APPLICATIONS

This application is the U.S. national stage of PCT/JP2018/006785 filed on Feb. 23, 2018, which claims priority of Japanese Patent Application No. JP 2017-041148 filed on Mar. 3, 2017, the contents of which are incorporated herein.

TECHNICAL FIELD

The present disclosure relates to a reactor.

BACKGROUND

JP2013-128084A discloses a reactor that includes: a coil that has a pair of winding portions that are arranged side by side; and a magnetic core with which a closed magnetic circuit is formed. The reactor is used as a constituent component of a convertor of a hybrid electric vehicle, for example. The magnetic core can be divided into an inner core portion that is disposed inside the winding portion, and an outer core portion that is disposed outside the winding portion. A combined member that includes the above-described coil and magnetic core combined with each other is housed in a casing.

A casing is used to physically protect a combined member, and is also used to fix the reactor to an installation target. However, in the reactor according to JP2013-128084A, the entire combined member is surrounded by the casing, and there is a problem in that its properties of dissipating heat from the combined body to the outside are unsatisfactory.

One objective of the present disclosure is to provide a reactor that has excellent heat dissipation properties despite being provided with a casing.

SUMMARY

A reactor according to the present disclosure is a reactor including a coil including a pair of winding portions that are arranged side by side and a magnetic core including inner core portions that are provided inside the winding portions, and an outer core portion that is exposed to the outside from the winding portions. A casing houses a combined member that includes the coil and the magnetic core combined with each other.

The casing includes a bottom plate on which the combined member is placed and a side wall that stands on the bottom plate, and the side wall is provided with a cutout for the core, through which at least a portion of the outer core portion is exposed to the outside of the casing.

DETAILED DESCRIPTION OF EMBODIMENTS OF THE DISCLOSURE

Figure 1:
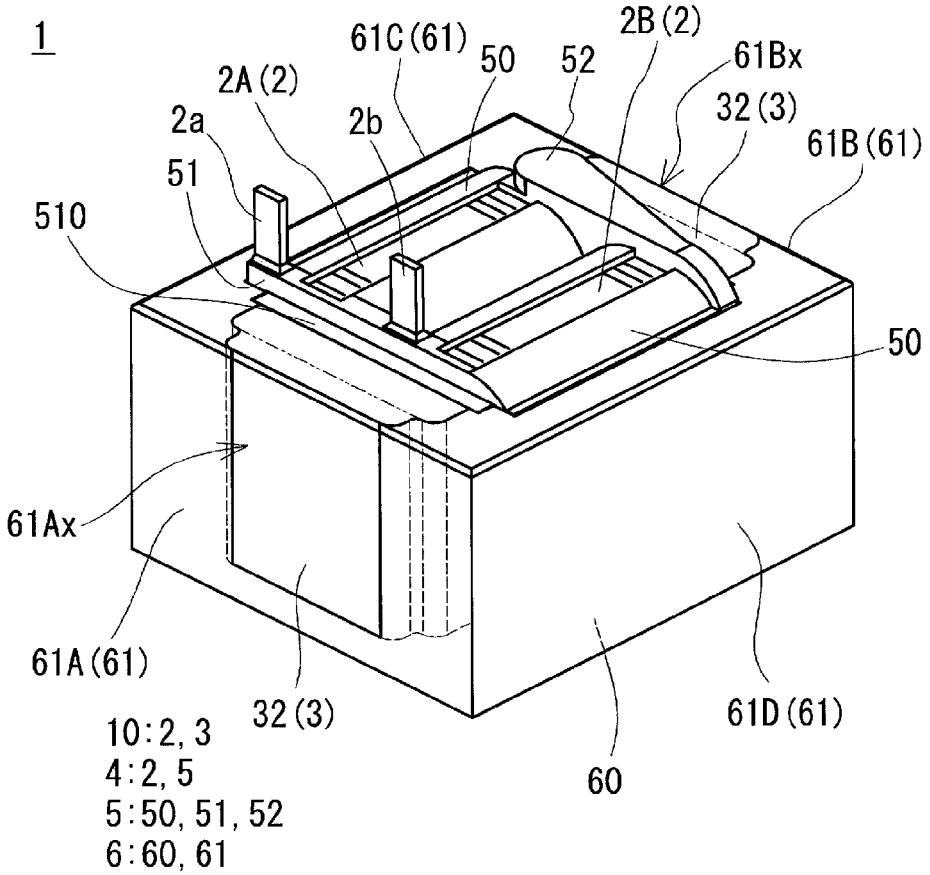
FIG. 1 is a perspective view of a reactor according to a first embodiment.

First, embodiments of the present disclosure are listed and described.

A reactor according to an embodiment is a reactor including a coil including a pair of winding portions that are arranged side by side and a magnetic core including inner core portions that are provided inside the winding portions, and an outer core portion that is exposed to the outside from the winding portions. A casing houses a combined member that includes the coil and the magnetic core combined with each other.

The casing includes a bottom plate on which the combined member is placed and a side wall that stands on the bottom plate, and the side wall is provided with a cutout for the core, through which at least a portion of the outer core portion is exposed to the outside of the casing.

Under certain operational conditions, a reactor may be operated under conditions where a loss in the magnetic core is large. In such a case, the amount of heat generated by the magnetic core may be greater than the amount of heat generated in the coil. If the magnetic core is surrounded by a casing, heat may remain in the reactor and the operation of the reactor may become unstable. In contrast, in the reactor according to the embodiment, a cutout for the core, through which a portion of the outer core portion is exposed to the outside of the casing, is provided in a side wall of the casing. Therefore, heat generated in the magnetic core is likely to be released to the outside of the casing. As a result, the heat dissipation properties of the reactor according to the embodiment are improved, and the operation of the reactor becomes stable.

Also, in the reactor according to the embodiment, stress that is applied in order to fix the reactor to an installation target is less likely to act on the combined member in the casing. For example, in a case where fittings for fastening the reactor from both sides in the axial direction of the winding portions are attached, and the reactor is fixed to an installation target using the fittings, the casing can take on the fastening force of the fittings. Also, in a case where the casing is provided with a fixing portion that has a screw hole, and the fixing portion is screwed to an installation target, the casing can take on the fastening force of the screw. In both cases, stress is not directly applied to the combined member in the casing.

In one aspect of the reactor according to the embodiment, the cutout for the core may constitute a through hole that is in communication with the inside and the outside of the side wall, and a portion of the outer core portion may be held in a state of being fitted into the through hole.

With the configuration in which a portion of the outer core portion is fitted into the through hole and engages with the through hole, it is possible to effectively prevent the combined member from detaching from the casing. Also, with the configuration in which the outer core portion is fitted into the through hole, the contact area between the outer core portion and the casing is large compared with a configuration in which the outer core portion is simply exposed to the outside at the bottom of the through hole and the outer core portion is not fitted into the through hole. Thus, it is possible to improve the heat dissipation properties of the magnetic core dissipating heat via the casing.

In one aspect of the reactor according to the embodiment, the bottom plate may be provided with a bottom hole through which at least a portion of the outer core portion is exposed to the outside below the casing.

With the configuration in which the outer core portion is exposed from the bottom plate as well, heat generated in the magnetic core is more likely to be released to the outside of the casing, and thus the heat dissipation properties of the reactor are improved.

In one aspect of the reactor according to the embodiment, the outer core portion may be formed using a composite material that contains soft magnetic powder and resin, and at least a portion of the outer core portion may be in contact with the inner surface of the casing.

A composite material is advantageous in that the magnetic properties thereof can be easily adjusted by adjusting the amount of soft magnetic powder. Also, a magnetic material can be filled into the casing, and the productivity of the reactor can be improved. If the magnetic core is manufactured by filling the casing with composite material, the magnetic core comes into contact with the inner surface of the casing, and heat is likely to be conducted from the magnetic core to the casing. As a result, heat is likely to be released to the outside of the casing via the casing.

In one aspect of the reactor according to the embodiment, the side wall may be provided with a cutout for the coil, through which the outer side surface of one of the winding portions in a side-by-side direction or the outer side surface of the other one of the winding portions in the side-by-side direction is exposed to the outside of the casing, the side-by-side direction being a direction in which the winding portions are arranged side by side.

With the configuration in which the outer side surface of one of the winding portions is exposed to the outside from the casing in addition to the outer core portion, it is possible to further improve the heat dissipation properties of the reactor.

In one aspect of the reactor according to the embodiment, the side wall may be provided with a cutout for the coil, through which the outer side surface of one of the winding portions in a side-by-side direction and the outer side surface of the other one of the winding portions in the side-by-side direction are exposed to the outside of the casing, the side-by-side direction being a direction in which the winding portions are arranged side by side.

With the configuration in which the outer side surfaces of both of the winding portions are exposed to the outside from the casing in addition to the outer core portion, it is possible to further improve the heat dissipation properties of the reactor.

In one aspect of the reactor according to the embodiment provided with the cutout for the coil, the portion of the winding portions exposed to the outside of the casing through the cutout for the coil may be provided with a heat dissipation member.

With the configuration in which the portion of the winding portions exposed to the outside of the casing through the cutout for the coil is provided with the heat dissipation member, it is possible to facilitate heat dissipation from the coil. For example, a heat dissipation fin that is attached using thermal grease or a heat dissipation sheet, or an attachment member for attaching the reactor to an installation target, may be used as the heat dissipation member. Of course, if the installation target has high thermal conductivity, the exposed portion of the winding portions may be attached directly to the installation target without using an attachment member. If this is the case, thermal grease or a heat dissipation sheet, which serves as a heat dissipation member, may be interposed between the exposed portion of the winding portions and the installation target.

In one aspect of the reactor according to the embodiment, the portion of the outer core portion exposed to the outside of the casing through the cutout for the core may be provided with a heat dissipation member.

With the configuration in which the portion of the outer core portion exposed to the outside of the casing through the cutout for the core is provided with the heat dissipation member, it is possible to facilitate heat dissipation from the outer core portion. Here, the thermal conductivity of a magnetic core that is made of a composite material that contains soft magnetic powder is approximately a tenth of that of a magnetic core constituted by a powder compact manufactured through pressure molding using soft magnetic powder, and is specifically approximately 3 W/m·K when the amount of soft magnetic powder contained is 70% by volume. Therefore, especially when the outer core portion is constituted by a composite material, it is preferable that the exposed portion of the outer core portion is provided with a heat dissipation member.

In one aspect of the reactor according to the embodiment, the coil may be provided with an integration resin portion formed using an insulative resin, and the integration resin portion may include: a turn coating portion that integrates turns of the winding portions with each other; and an end surface coating portion that is interposed between the end surfaces of the winding portions and the outer core portion.

With the configuration in which the turn coating portion integrates the turns of the coil with each other, when the internal spaces of the winding portions are filled with composite material in order to manufacture a reactor, it is possible to prevent the composite material from leaking from gaps between the turns of the winding portions. Also, it is possible to ensure insulation between: the end surfaces of the winding portions; and the outer core portion, using the end surface coating portion of the integration resin portion.

The following describes embodiments of a reactor according to the present disclosure with reference to the drawings. The same reference numerals in the drawings indicate elements that have the same name. Note that the present disclosure is not limited to the configurations shown in the embodiments, and is specified by the scope of claims. All changes that come within the meaning and range of equivalency of the claims are intended to be embraced therein.

First Embodiment

The first embodiment describes a configuration of a reactor 1 with reference to FIGS. 1 to 4. The reactor 1 shown in FIG. 1 includes a combined member 10 that includes a coil 2 and a magnetic core 3 combined with each other, and a casing 6 that houses the combined member 10. One feature of the reactor 1 lies in that portions of the magnetic core 3 are exposed to the outside of the casing 6 through cutouts 61Ax and 61Bx for the core, which are provided in the casing 6. The following describes the details of each of the components of reactor 1, and subsequently describes a method for manufacturing the reactor 1.

Coil

Figure 3:
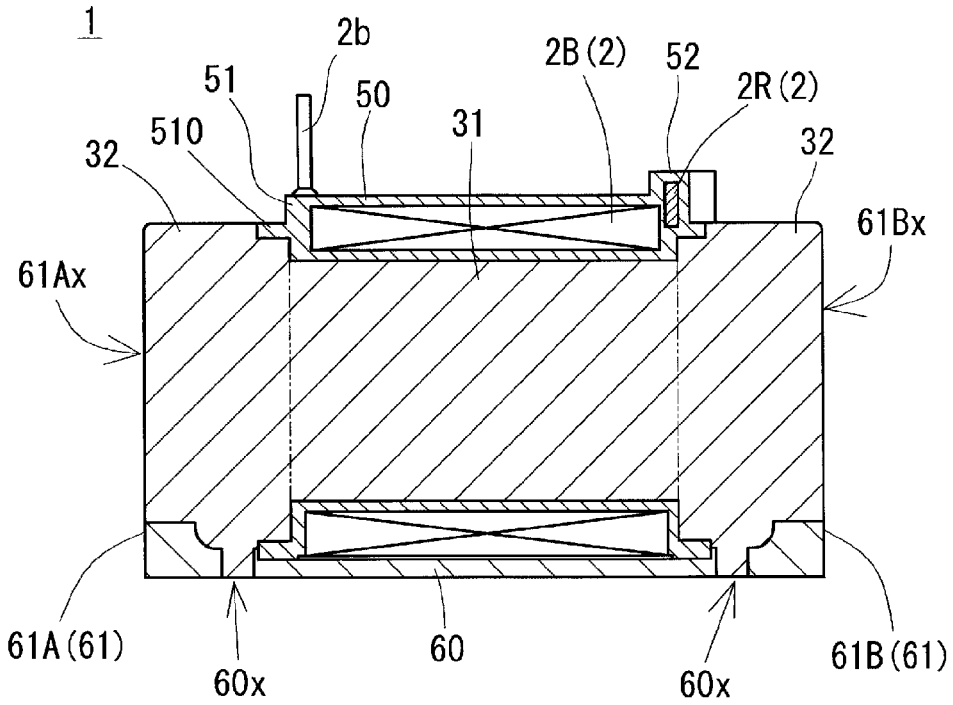
FIG. 3 is a cross-sectional view taken along a line III-III in FIG. 2
Figure 4:
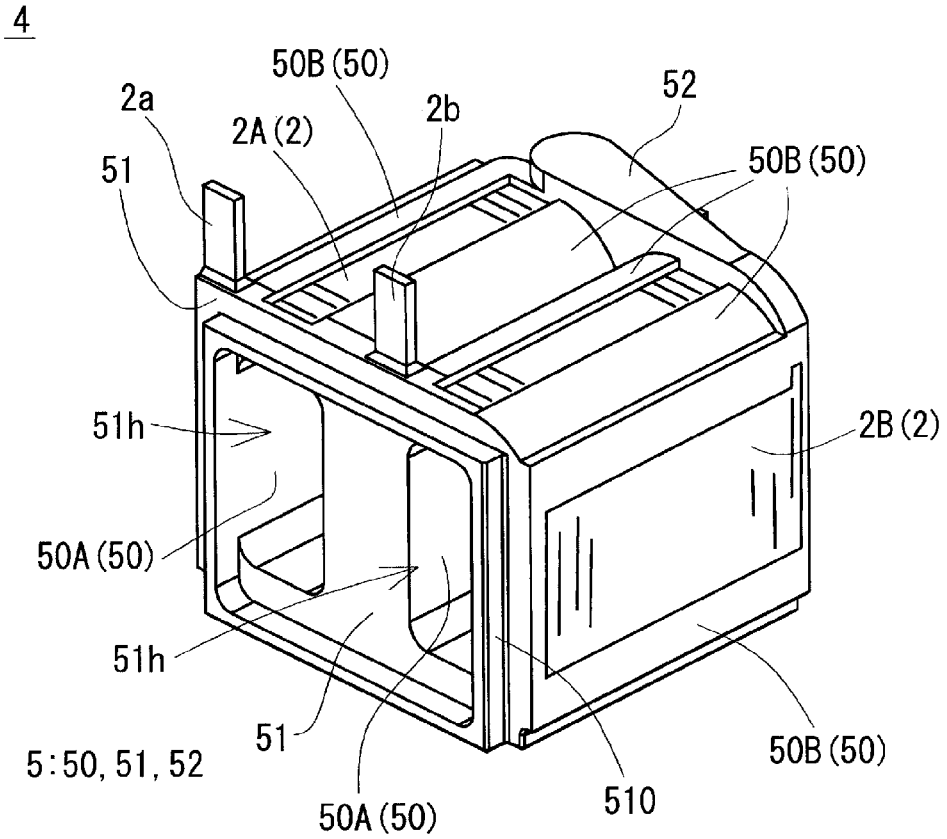
FIG. 4 is a perspective view of a molded coil member that is provided in the reactor according to the first embodiment.

As shown in FIG. 4, the coil 2 according to the present embodiment includes a pair of winding portions 2A and 2B and a coupling portion 2R (FIG. 3) that couples the winding portions 2A and 2B to each other. The winding portions 2A and 2B provided in the coil 2 in the present embodiment are portions formed by spirally winding a winding wire. The winding portions 2A and 2B are formed so as to have a hollow tubular shape by winding the winding wire the same number of times in the same direction, and are arranged side by side such that their respective axes are parallel with each other. The winding portions 2A and 2B may be different from each other in the number of turns and the cross-sectional area of the winding wire. Although the coil 2 is manufactured with a single winding wire in the preset embodiment, the coil 2 may be manufactured by coupling winding portions 2A and 2B that have been respectively formed with separate winding wires.

The winding portions 2A and 2B in the present embodiment are formed so as to have a rectangular tube shape. The winding portions 2A and 2B that have a rectangular tube shape are winding portions whose end surfaces have a rectangular shape (which may be a square shape) with rounded corners. Of course, the winding portions 2A and 2B may be formed so as to have a cylindrical shape. Winding portions with a cylindrical shape are winding portions whose end surfaces have a closed curved surface shape (such as an elliptical shape, a perfect circular shape, or a race track shape).

The coil 2 including the winding portions 2A and 2B may be formed of a coated wire in which the outer circumferential surface of a conductor such as a flat wire or a round wire that is made of a conductive material such as copper, aluminum, magnesium, or an alloy thereof is coated with an insulative coating that is made of an insulative material. In the present embodiment, the winding portions 2A and 2B are formed through edgewise-winding of a coated flat wire that includes a conductor that is made of a copper flat wire (a winding wire) and an insulative coating that is made of enamel (typically a polyimide-based resin).

Two end portions 2*a* and 2*b* of the coil 2 are drawn out from the winding portions 2A and 2B, and are connected to a terminal member, which is not shown. The insulative coating, which is made of enamel or the like, has been stripped from the end portions 2*a* and 2*b*. An external device such as a power supply for supplying power to the coil 2 is connected via the terminal member.

Integration Resin Portion

The coil 2 in the present embodiment is used in the form of a molded coil member 4 that includes an integration resin portion 5 that firmly integrates the turns of the winding portions 2A and 2B into one piece so that the turns do not separate from each other. The integration resin portion 5 has the function of preventing the winding portions 2A and 2B from expanding, and the function of ensuring insulation between the coil 2 and the magnetic core 3 (FIG. 1). The integration resin portion 5 can be formed using a thermoplastic resin, such as a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, or an acrylonitrile butadiene styrene (ABS) resin, for example. Alternatively, the integration resin portion 5 may be formed using a thermosetting resin such as an unsaturated polyester resin, an epoxy resin, a urethane resin, or a silicone resin, for example. It is also possible to improve the heat dissipation properties of the integration resin portion 5 by adding a ceramic filler to the aforementioned resins. Non-magnetic powder of alumina, silica, boron nitride, or aluminum nitride, for example, may be used as the ceramic filler.

The integration resin portion 5 in the present embodiment includes turn coating portions 50 that integrate the turns of the winding portions 2A and 2B into one piece, and an end surface coating portion 51 that is interposed between end surfaces of the winding portions 2A and 2B and outer core portions 32. The integration resin portion 5 also includes a coupling portion coating portion 52 that covers the coupling portion 2R (FIG. 3) of the winding portions 2A and 2B.

The turn coating portions 50 include inner coating portions 50A that cover the inner circumferential surfaces of the winding portions 2A and 2B, and outer coating portions 50B that cover at least portions of the outer circumferential surfaces of the winding portions 2A and 2B (FIG. 4). The inner coating portions 50A cover the entire inner circumferential surfaces of the winding portions 2A and 2B to prevent the winding portions 2A and 2B from expanding, and to ensure insulation between: the winding portions 2A and 2B; and inner core portions 31 (FIG. 3) that are disposed inside the winding portions 2A and 2B. The outer coating portions 50B cover four corner portions of the outer circumferential surface of each of the winding portions 2A and 2B formed by bending the winding wires, to prevent the winding portions 2A and 2B from expanding. The outer coating portions 50B are not formed on flat portions of the winding portions 2A and 2B, where the winding wire is not bent, and the flat portions are exposed to the outside of the integration resin portion 5. Therefore, heat dissipated from the outer side surfaces of the winding portions 2A and 2B is not blocked by the outer coating portions 50B.

The end surface coating portion 51 is provided so as to couple the turn coating portion 50 of the winding portion 2A and the turn coating portion 50 of the winding portion 2B. The end surface coating portion 51 is provided with a pair of through holes 51*h* that are in communication with the internal spaces of the winding portions 2A and 2B. The inner core portions 31 (FIG. 3) are inserted into the winding portions 2A and 2B via these through holes 51*h*.

The end surface coating portion 51 includes a frame portion 510 that has a frame shape and protrudes away from the coil 2 in the axial direction of the winding portions 2A and 2B. The outer side surfaces (surfaces in the direction in which the winding portions 2A and 2B are arranged side by side) of the frame portion 510 abut against steps of coil-facing walls 61C and 61D of the casing 6 (see FIGS. 1 and 2). The frame portion 510 has the function of positioning the coil 2 relative to the casing 6, and the function of preventing a composite material from leaking when the reactor 1 is being manufactured.

The integration resin portion 5 may be realized in the form of a fused resin portion by forming a coating layer of a thermally fusible resin on the outer circumferential surface of the winding wire (the outer circumferential surface of the insulative coating of enamel or the like) and thermally fusing portions of the coating layer with each other, for example. In this form, the integration resin portion 5 can be made very thin, e.g. no greater than 1 mm, or even, no greater than 100 μm. Therefore, it is possible to improve the heat dissipation properties of the coil 2. Also, it is possible to form the winding portions 2A and 2B as separately integrated members, and thus it is possible to facilitate heat dissipation from the coil 2 via the winding portions 2A and 2B. In addition, it is possible to dispose a heat dissipation member between the winding portions 2A and 2B, and dispose various sensors for measuring the temperature of the coil 2 and so on.

The integration resin portion 5 formed as a fused resin portion is very thin. Therefore, even if the turns of the winding portions 2A and 2B are integrated by the integration resin portion 5, the shapes of the turns of the winding portions 2A and 2B and the boundaries between the turns can be externally discerned. For example, a thermosetting resin such as an epoxy resin, a silicone resin, or an unsaturated polyester resin may be used.

Magnetic Core

The magnetic core 3 is a magnetic member constituted by a powder compact or a composite material. As shown in FIG. 3, for the sake of convenience, the magnetic core 3 can be divided into the inner core portions 31 that are disposed inside the winding portions 2A and 2B, and the outer core portions 32 that are disposed outside the winding portions 2A and 2B. The inner core portions 31 and the outer core portions 32 may be formed using different materials, or formed with the same material. In the former case, the inner core portions 31 may be formed with a powder compact and the outer core portions 32 may be formed using a composite material, for example. In the latter case, the inner core portions 31 and the outer core portions 32 may be integrally formed using a composite material. In the present embodiment, the core portions 31 and 32 are integrally formed using a composite material.

The composite material is a magnetic member containing soft magnetic powder and resin. Soft magnetic powder is an aggregation of magnetic particles that include particles of an iron-group metal such as iron, an alloy thereof (an Fe—Si alloy, an Fe—Si—Al alloy, an Fe—Ni alloy, etc.), or the like. Insulative coatings that are made of a phosphate or the like may be formed on the surfaces of the magnetic particles. Examples of the resin include a thermosetting resin such as an epoxy resin, a phenol resin, a silicone resin, or a urethane resin, a thermoplastic resin such as a PPS resin, a PA resin, e.g. nylon 6 or nylon 66, a polyimide resin, or a fluororesin. The composite material may contain a filler or the like. Available examples of the filler include calcium carbonate, talc, silica, clay, various fibers such as aramid fibers, carbon fibers, and glass fibers, mica, and glass flakes. The powder compact is a magnetic member formed through pressure molding, using a raw material powder that contains soft magnetic powder.

The outer core portions 32 may be formed using a composite material, and the inner core portions 31 may be formed with a powder compact, unlike in the present embodiment. The inner core portions 31 may be formed of a single powder compact, or formed by connecting core pieces of a powder compact and gap plates one after the other. The gap plates are plate members that are made of a non-magnetic material such as alumina.

As shown in the method for manufacturing a reactor described below, the outer core portions 32 in the present embodiment are formed by injection-molding composite material in the casing 6 or filling the casing 6 with composite material after housing the molded coil member 4 in the casing 6. Therefore, the outer core portions 32 of the magnetic core 3 are in contact with the inner surface of the casing 6.

Portions of the outer core portions 32, specifically portions of their end surfaces in the axial direction of the winding portions 2A and 2B in the present embodiment, are exposed to the outside of the casing 6 through the cutouts 61Ax and 61Bx for the core (FIGS. 1 and 2) that are provided in side walls 61 of the casing 6 describe below. The outer surfaces of the outer core portions 32 exposed to the outside from the casing 6 are flush with the outer surfaces of the side walls 61 of the casing 6. The exposed portions of the outer core portions 32 may be provided with a heat dissipation member such as a heat dissipation fin. Thermal grease or a heat dissipation sheet may be interposed between the heat dissipation fin and the outer core portions 32.

Casing

Figure 2:
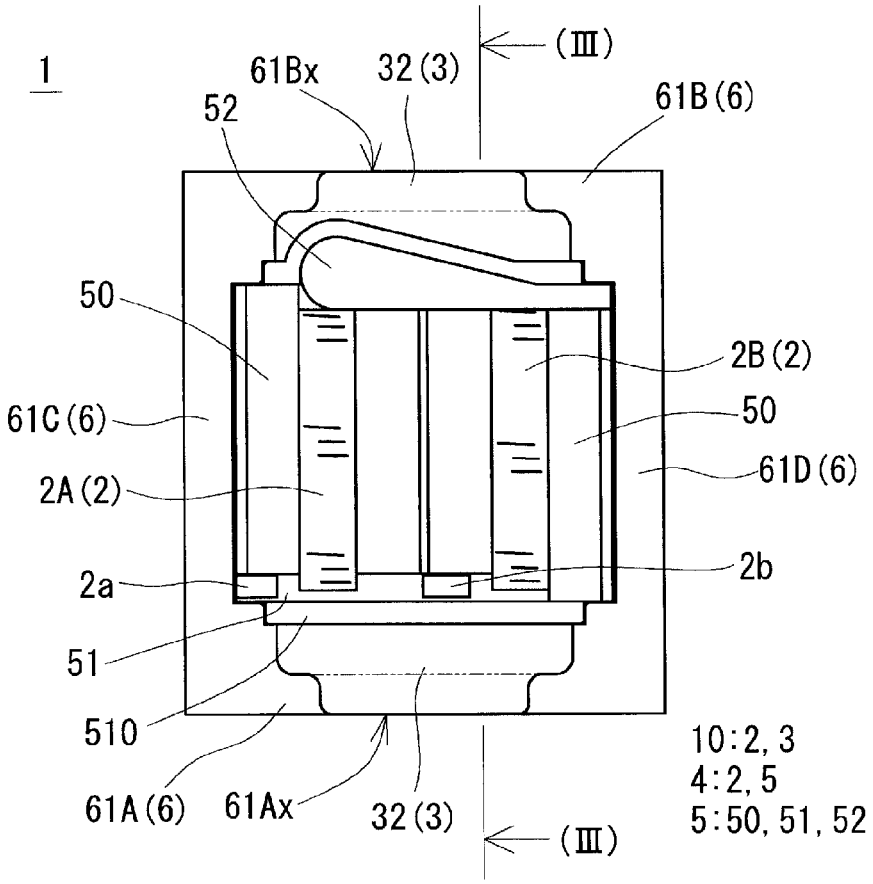
FIG. 2 is a schematic top view of the reactor according to the first embodiment.

As shown in FIGS. 1 and 2, the casing 6 includes a bottom plate 60 and side walls 61. The bottom plate 60 and the side walls 61 may be formed integrally with each other, or formed by coupling a bottom plate 60 and side walls 61 that are separately prepared, to each other. Available examples of the material of the casing 6 include aluminum, an alloy thereof, a nonmagnetic metal such as magnesium or an alloy thereof, or resin. If the bottom plate 60 and the side walls 61 are configured as separate members, it is possible to differ the materials of the bottom plate 60 and the side walls 61 from each other. For example, it is possible to employ a configuration in which the bottom plate 60 is made of a non-magnetic material and the side walls 61 are made of resin, or vice versa.

The side walls 61 in the present embodiment include a pair of core-facing walls 61A and 61B that face the outer surfaces of the outer core portions 32, and a pair of coil-facing walls 61C and 61D that face the outer circumferential surfaces of the winding portions 2A and 2B. The core-facing walls 61A and 61B are parallel with each other, and are apart from each other in the axial direction of the winding portions 2A and 2B. The coil-facing walls 61C and 61D are parallel with each other, and are apart from each other in the direction in which the winding portions 2A and 2B are arranged side by side.

In the present embodiment, the core-facing walls 61A and 61B are respectively provided with the cutouts 61Ax and 61Bx for the core, through which portions of the outer core portions 32 are exposed to the outside of the casing 6. Portions of the outer core portions 32 are located within the cutouts 61Ax and 61Bx for the core (see the portions outside the two-dot dash lines in FIGS. 1 and 2). Although the cutouts 61Ax and 61Bx for the core are not limited to any particular shape or size, the cutouts 61Ax and 61Bx for the core in the present embodiment are rectangular as shown in FIG. 1. Although one cutout 61Ax (61Bx) for the core is provided in the present embodiment, a plurality of cutouts 61Ax (61Bx) for the core may be provided. The upper ends of the rectangular cutouts 61Ax and 61Bx for the core reach the upper ends of the core-facing walls 61A and 61B, the lower ends of the same are located slightly upward of the bottom plate 60, and the left and right ends of the same are located inward of the left and right end surfaces of the outer core portions 32. The above-described lower ends may reach the bottom plate 60. However, the rigidity of the casing 6 can be improved by positioning the lower ends so as to be located slightly upward of the bottom plate 60 as in the present embodiment. The cutouts 61Ax and 61Bx for the core with such dimensions and shape increase the area of the portions of the outer core portions 32 exposed to the outside from the casing 6. Also, the length of the cutouts 61Ax and 61Bx for the core in the left-right direction is shorter than the length of the outer core portion 32 in the left-right direction, and such a configuration prevents the combined member 10 from detaching from the casing 6 in the axial direction of the winding portions 2A and 2B.

As shown in the III-III cross-sectional view in FIG. 3, the casing 6 in the present embodiment is provided with bottom holes 60*x* in the bottom plate 60. Portions of the outer core portions 32 are located within the bottom holes 60*x* as well, and the portions within the bottom holes 60*x* are flush with the bottom surface of the bottom plate 60. Therefore, heat from the outer core portions 32 can be easily released from the bottom surface side of the casing 6.

Effects of Reactor

With the reactor 1 in the present embodiment, stress that is applied in order to fix the reactor 1 to an installation target is less likely to act on the combined member 10 in the casing 6. For example, in a case where fittings for fastening the reactor 1 from both sides in the axial direction of the winding portions 2A and 2B are attached, and the reactor 1 is fixed to an installation target using the fittings, the casing 6 can take on the fastening force of the fittings. Also, in a case where the casing 6 is provided with a fixing portion that has a screw hole, and the fixing portion is screwed to the installation target, the casing 6 can take on the fastening force of the screw. In both cases, stress is not directly applied to the combined member 10 in the casing 6.

Also, the outer side surfaces of the outer core portions 32 are exposed to the outside from the side walls 61 of the casing 6, and therefore heat from the outer core portions 32 is likely to be released to the outside of the casing 6, and thus the heat dissipation properties of the reactor 1 can be further improved.

Usage

The reactor 1 in the present embodiment can be used as a constituent member of a power converter such as a bidirectional DC-DC converter provided in an electric vehicle such as a hybrid electric vehicle, an electric car, or a fuel cell car.

Reactor Manufacturing Method

Next, a reactor manufacturing method for manufacturing the reactor 1 according to the first embodiment will be described.

First, the molded coil member 4 shown in FIG. 4 is prepared. The molded coil member 4 is disposed in the casing 6, and the casing 6 is disposed in a mold. The mold is not limited to any particular configuration, provided that, when the magnetic core 3 is formed in the casing 6 using a composite material, the composite material does not leak to the outside of the casing 6. For example, the mold may cover the entire outer surface of the casing 6 including the upper opening of the casing 6, or only cover the cutouts 61Ax and 61Bx for the core and the bottom holes 60*x*.

Next, composite material is injection-molded in the internal space of the casing 6, or is filled into the internal space, to form the inner core portions 31 inside the winding portions 2A and 2B, and to form the outer core portions 32 that are in contact with the inner surface of the casing 6. Upon the composite material in the casing 6 solidifying or being cured, the mold is removed, and thus the reactor 1 is complete.

Note that, if the inner core portions 31 are constituted by combining core pieces and gap plates, the inner core portions 31 are inserted into the through holes 51*h* of the molded coil member 4, and the combined member of the molded coil member 4 and the inner core portions 31 are housed in the casing 6. Thereafter, the casing 6 that houses the molded coil member 4 is positioned in a mold, and an uncured composite material is injection-molded in the casing 6 or is filled into the casing 6. If this is the case, a gap plate is positioned at both ends of the inner core portions 31, and thus it is possible to prevent the inner core portions 31 from being damaged due to a composite material coming into contact with the inner core portions 31 when injection molding is performed.

Second Embodiment

Figure 5:
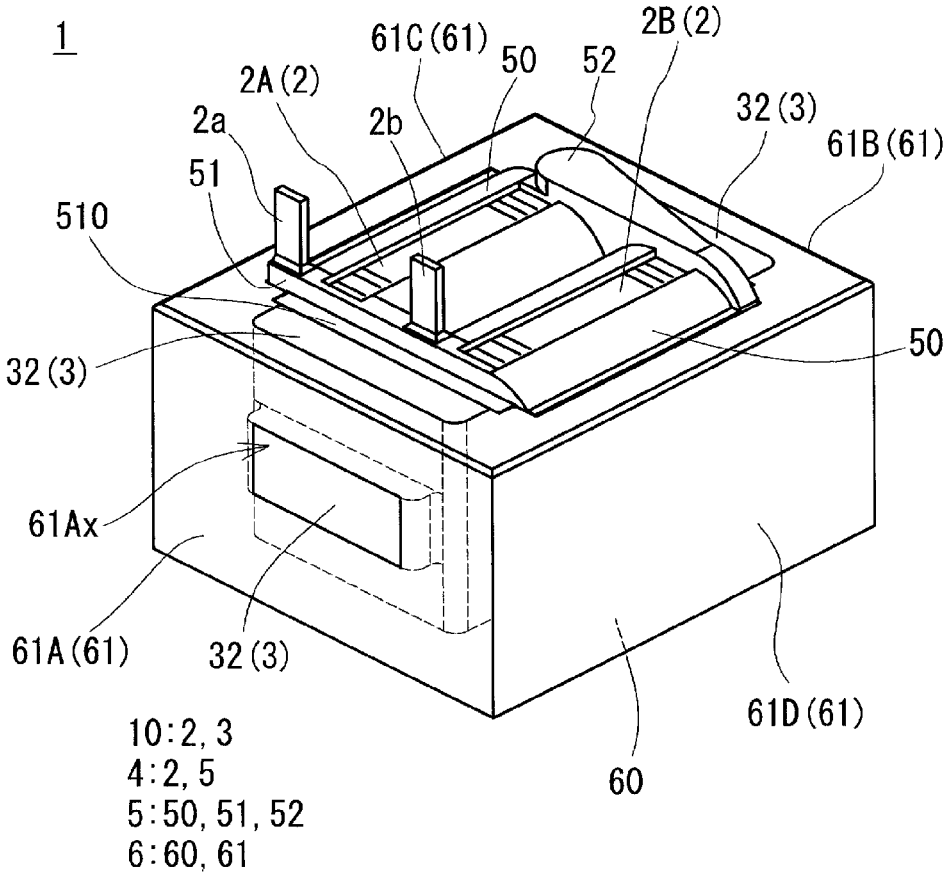
FIG. 5 is a perspective view of a reactor according to a second embodiment.

The second embodiment describes a configuration in which the core-facing walls 61A and 61B of the casing 6 are provided with a cutout 61Ax for the core, which constitutes a through hole, with reference to FIG. 5. Although the cutout for the core provided in the core-facing wall 61B is not shown in the figure, this cutout has the same configuration as the cutout 61Ax for the core.

As shown in FIG. 5, the cutout 61Ax for the core in the present embodiment constitutes a through hole that is in communication with the inside and the outside of the side wall 61. A portion of an outer core portion 32 is fitted into the cutouts 61Ax for the core that constitute a through hole, and the portion fitted into the cutout 61Ax for the core is flush with the outer surface of the core-facing wall 61A. In this configuration, portions of the outer core portions 32 are exposed to the outside from the side walls 61 of the casing 6, and thus heat from the outer core portions 32 is likely to be released laterally.

Since the cutout 61Ax for the core constitutes a through hole, the upper surface of the portion of the outer core portion 32 fitted into the cutout 61Ax for the core engages with the inner surface of the cutout 61Ax for the core. Therefore, the combined member 10 does not detach from the casing 6 even if the casing 6 is laid on its side or is positioned upside down. That is to say, flexibility is improved in terms of the direction in which the reactor 1 is attached to the installation target. Also, with such a configuration, a portion of the outer core portion 32 is exposed to the outside from the cutout 61Ax for the core, and the area of contact with the casing 6 is large compared to the configuration in which such a portion is not fitted into the cutout 61Ax for the core. Therefore, heat from the outer core portion 32 is more likely to be dissipated via the casing 6.

Third Embodiment

Figure 6:
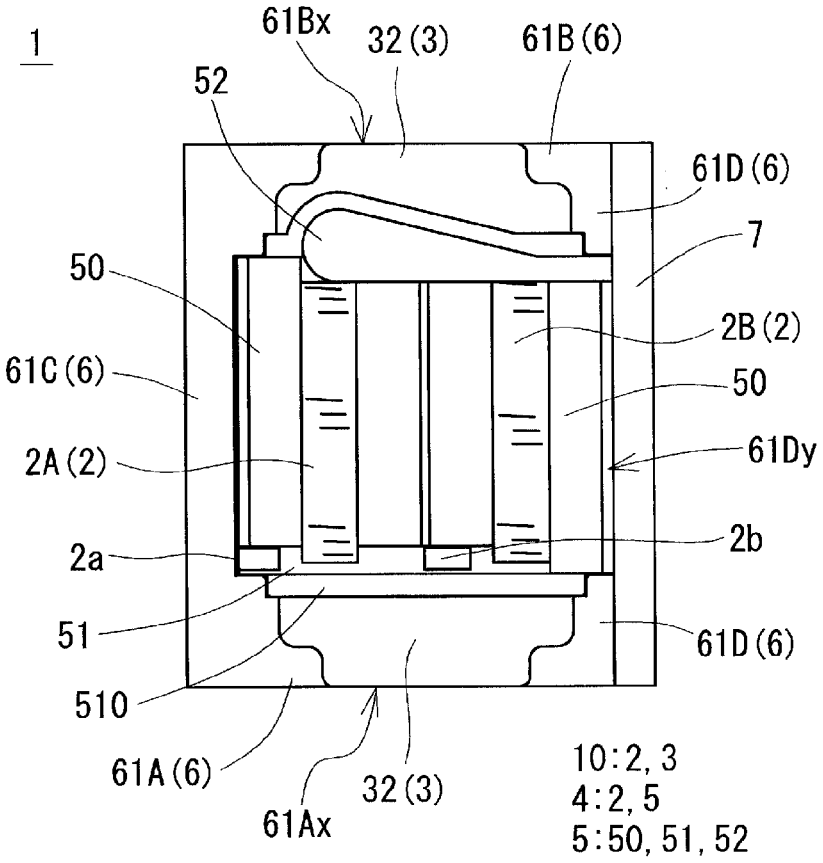
FIG. 6 is a schematic top view of a reactor according to a third embodiment.

The third embodiment describes the reactor 1 in which, in addition to the outer core portions 32, the outer side surface of one of the winding portions 2A and 2B is exposed to the outside from the casing 6, with reference to FIG. 6. Components that have the same functions as those in the first embodiment are assigned the same reference numerals as those in the first embodiment, and descriptions thereof are omitted.

FIG. 6 is a schematic top view of the reactor 1 according to the third embodiment. As shown in FIG. 6, the casing 6 in the present embodiment is provided with a cutout 61Dy for the coil in the coil-facing wall 61D, in addition to the cutouts 61Ax and 61Bx for the core. The outer side surface of the winding portion 2B in the direction in which the winding portions 2A and 2B are arranged side by side is exposed to the outside of the casing 6 from the cutout 61Dy for the coil.

Although the cutout 61Dy for the coil is not limited to any particular shape or size, the cutout 61Dy for the coil in the present embodiment is rectangular. Also, although one cutout 61Dy for the coil is provided in the present embodiment, a plurality of cutouts 61Dy for the coil may be provided. The upper end (the end on the near side in the drawing) of the rectangular cutout 61Dy for the coil in the present embodiment reaches the upper end of the coil-facing wall 61D, the lower end (the end on the far side in the drawing) of the same is located higher than the lower bent corner portions of the winding portions 2A and 2B, and the left and right ends (the ends in the top-bottom direction in the drawing) of the same are approximately flush with the end surfaces of the winding portions 2A and 2B in the axial direction. The cutout 61Dy for the coil with such dimensions and shape increases the area of the portion of the winding portion 2B exposed to the outside from the casing 6. Also, although the area of the cutout 61Dy for the coil is almost the same as the area of the winding portion 2B in a side view, it is smaller than the area of the molded coil member 4 including the integration resin portion 5 in a side view. Therefore, it is possible to prevent the combined member 10 from detaching from the casing 6 in the direction in which the winding portions 2A and 2B are arranged side by side.

In the reactor 1 in the third embodiment, a reinforcing member 7 is provided on the outer circumferential surface of the winding portion 2B exposed from the cutout 61Dy for the coil. The reinforcing member 7 in the present embodiment has the same length as the length of the casing 6 in the axial direction of the winding portion 2B, and serves to maintain the strength of the coil-facing wall 61D in the axial direction of the winding portion 2B. Therefore, for example, in a case where the coil-facing wall 61D is fastened in the axial direction of the winding portion 2B and lateral fixing is performed with the reinforcing member 7 being used as a surface that is attached to an installation target, the reinforcing member 7 can take on the fastening pressure, and prevent the casing 6 from deforming and reduce the stress applied to the combined member 10 due to such deformation.

In addition, the reinforcing member 7 in the present embodiment is constituted by a material that has the same or higher thermal conductivity compared to the casing 6, and also functions as a heat dissipation member that improves the heat dissipation properties of the coil 2. A thermal conduction material such as thermal grease or a heat dissipation foam sheet may be interposed between the winding portion 2B and the reinforcement member (heat dissipation member) 7 to improve thermal conduction from the winding portion 2B to the reinforcing member 7.

If lateral fixing is performed with the reinforcing member 7 being used as a surface that is attached to an installation target without fastening the coil-facing wall 61D, the reinforcing member 7 need not be provided. In such a case, thermal grease or a heat dissipation sheet may be interposed between the coil-facing wall 61D and the installation target.

Fourth Embodiment

Figure 7:
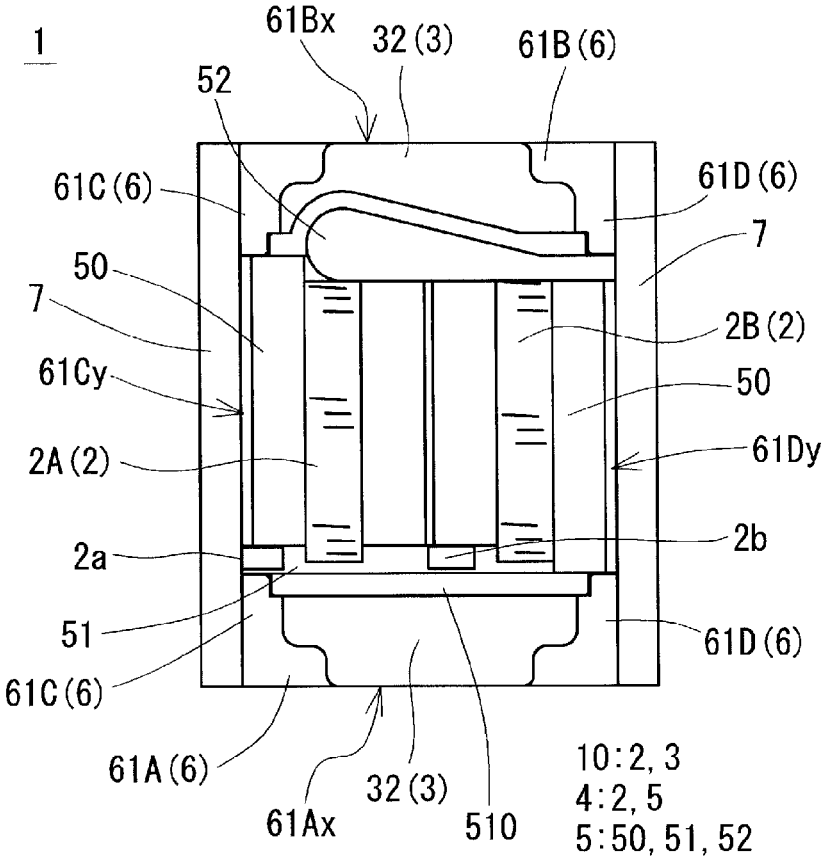
FIG. 7 is a schematic top view of a reactor according to a fourth embodiment.

The fourth embodiment describes the reactor 1 in which, in addition to the outer core portions 32, the outer side surfaces of both winding portions 2A and 2B are exposed to the outside from the casing 6, with reference to FIG. 7. Components that have the same functions as those in the third embodiment are assigned the same reference numerals as those in the third embodiment, and descriptions thereof are omitted.

FIG. 7 is a schematic top view of the reactor 1 according to the fourth embodiment. As shown in FIG. 7, in the casing 6 in the present embodiment, the coil-facing wall 61C is also provided with a cutout 61Cy for the coil, in addition to the cutout 61Dy for the coil. With this configuration, the combined member 10 is exposed to the outside of the casing 6 in four directions, and it is easier to improve the heat dissipation properties of the reactor 1.

The side walls 61 in the present embodiment are like four columns separated from each other. Therefore, in a case where the reactor 1 is fastened using fittings or the like and is thereby fixed to an installation target, it is preferable that the side walls 61 have a certain yield strength in the fastening direction. In the example shown in FIG. 7, it is envisaged that a fastening force is applied in the axial direction of the winding portions 2A and 2B, and therefore the reinforcing members 7 that have the same length as the coil-facing walls 61C and 61D are respectively provided outside the coil-facing walls 61C and 61D. As in the third embodiment, these reinforcing members 7 are constituted by a material that has the same or higher thermal conductivity compared to the casing 6, and thus facilitate heat dissipation from the winding portions 2A and 2B.

The invention claimed is:

1. A reactor comprising:

a coil including a pair of winding portions that are arranged side by side;

a magnetic core including inner core portions that are provided inside the winding portions, and an outer core portion that is exposed to the outside from the winding portions; and a casing that houses a combined member that includes the coil and the magnetic core combined with each other, wherein the casing includes:

a bottom plate on which the combined member is placed; and a side wall that stands on the bottom plate, and the side wall is provided with a cutout for the core, through which at least a portion of the outer core portion is exposed to the outside of the casing, and wherein an outer surface of the portion of the outer core exposed to the outside of the casing is flush with an outer surface of the casing.

2. The reactor according to claim 1, wherein the cutout for the core constitutes a through hole that is in communication with the inside and the outside of the side wall, and a portion of the outer core portion is held in a state of being fitted into the through hole.

3. The reactor according to claim 1, wherein the bottom plate is provided with a bottom hole through which at least a portion of the outer core portion is exposed to the outside below the casing.

4. The reactor according to claim 1, wherein the outer core portion is formed using a composite material that contains soft magnetic powder and resin, and at least a portion of the outer core portion is in contact with the inner surface of the casing.

5. The reactor according to claim 1, wherein the side wall is provided with a cutout for the coil, through which the outer side surface of one of the winding portions in a side-by-side direction or the outer side surface of the other one of the winding portions in the side-by-side direction is exposed to the outside of the casing, the side-by-side direction being a direction in which the winding portions are arranged side by side.

6. The reactor according to claim 1, wherein the side wall is provided with a cutout for the coil, through which the outer side surface of one of the winding portions in a side-by-side direction and the outer side surface of the other one of the winding portions in the side-by-side direction are respectively exposed to the outside of the casing, the side-by-side direction being a direction in which the winding portions are arranged side by side.

7. The reactor according to claim 5, wherein the portion of the winding portions exposed to the outside of the casing through the cutout for the coil is provided with a heat dissipation member.

8. The reactor according to claim 1, wherein the portion of the outer core portion exposed to the outside of the casing through the cutout for the core is provided with a heat dissipation member.

9. The reactor according to claim 1, wherein the coil is provided with an integration resin portion formed using an insulative resin, and the integration resin portion includes:

a turn coating portion that integrates turns of the winding portions with each other; and an end surface coating portion that is interposed between end surfaces of the winding portions and the outer core portion.

* * * * *